US006196330B1

(12) United States Patent
Matthias et al.

(10) Patent No.: US 6,196,330 B1
(45) Date of Patent: Mar. 6, 2001

(54) MANUALLY OPERABLE DRILLING TOOL WITH DUAL IMPACTING FUNCTION

(75) Inventors: Blessing Matthias, Frastanz; Günther Joachim, Nüziders, both of (AT); Kauf Adrian, Wangen (DE)

(73) Assignee: Hilti Aktiengesellschaft, Schaan (LU)

( * ) Notice: Subject to any disclaimer, the term of this patent is extended or adjusted under 35 U.S.C. 154(b) by 0 days.

(21) Appl. No.: 09/358,591

(22) Filed: Jul. 21, 1999

(30) Foreign Application Priority Data

Jul. 25, 1998 (DE) ..... 198 33 650

(51) Int. Cl.[7] ..... B25D 9/00; B25D 11/00
(52) U.S. Cl. ..... 173/48; 173/109; 173/201
(58) Field of Search ..... 173/48, 47, 109, 173/201, 205, 110, 117; 74/22 R, 22 A

(56) References Cited

U.S. PATENT DOCUMENTS 3,000,225 * 9/1961 Taylor ..... 173/48
3,809,168 * 5/1974 Fromm ..... 173/48
3,834,468 * 9/1974 Hettich et al. ..... 173/48
3,847,229 * 11/1974 Wanner et al. ..... 173/48
3,867,988 * 2/1975 Koehler ..... 173/48
4,064,949 * 12/1977 Chromy ..... 173/117
4,114,699 * 9/1978 Wolf ..... 173/109
5,161,624 * 11/1992 Beck et al. ..... 173/47
5,806,609 * 9/1998 Stock et al. ..... 173/205

* cited by examiner

*Primary Examiner*—Peter Vo
*Assistant Examiner*—Jim Calve
(74) *Attorney, Agent, or Firm*—Brown & Wood, LLP

(57) ABSTRACT

A manually operable drilling tool (1) wiht dual impacting funtion has a housing (2) containing a first striking mechanism (16) for producing axial impacts to be transferred to a drilling or chiseling tool bit (7), clamped in a chuck (6) of the tool (1). Within the housing (2), a second striking mechanism (20) is arranged for producing axial impacts, the axial impacts of which have an impact energy and an impact frequency different from the impact energy and the impact frequency of the axial impacts produced by the first striking mechanism (16). The drilling or chiseling tool bit (7), clamped in the chuck (6), can be acted upon with axial impacts produced either by the first (16) or the second striking mechanism (20) or by both striking mechanisms together. The axial impact striking, mechanisms (16, 20) can also be switched off completely for use in wood or metal.

11 Claims, 3 Drawing Sheets

MANUALLY OPERABLE DRILLING TOOL WITH DUAL IMPACTING FUNCTION

FIELD OF THE INVENTION

The invention relates to a manually operable drilling tool with a striking mechanism for producing axial impacts. The drilling tool includes a housing with a chuck fitted on the housing for rotating a tool bit secured in the chuck. The striking mechanism periodically transfers axial impacts to the tool bit

BACKGROUND INFORMATION AND PRIOR ART

In fastening and excavating technology, manually operable drilling tools are known, which have a driving mechanism for imparting rotary motion to a drilling tool and are equipped with a striking mechanism for producing pulse-like impacts. The axial impacts support the excavating action of the drilling tool, especially when drilling in brittle, failing material, such as concrete, rock, brick masonry and the like. For working on very hard and compact materials, such as concrete and rock, manually operable drilling tools, equipped with an electro-pneumatic striking mechanism, prove to be very appropriate, such handheld or manually operable drilling equipment has long been known and is sold, for example, by the Assignee. The electro-pneumatic striking mechanism of such drilling equipment is designed for producing axial impacts with a high individual impact energy of, for example, about 2 J to about 8 J at a relatively low impact frequency of, for example, about 45 Hz to about 80 Hz. Because of the high energy of the individual axial impacts, manually operable drilling tools are not as suitable for working hollow brick masonry.

Aside from the manually operable drilling tools with an electro-pneumatic striking mechanism, other drilling tools are also known, which have a mechanical striking mechanism. These include the ratchet drills, known primarily for home owner use and the manually operable drills with a spring U-bolt striking mechanism or a spring-cam stroking mechanism employed in semi-professional and professional use. The striking mechanisms of these known handheld drilling tools produce axial impacts with a relatively low single impact energy of, for example, about 0.03 J to about 0.3 J with a relatively high impact frequency, which amounts to about 700 Hz., for example. Because of the low energy of the individual impacts, it is possible to work with impact support on hollow brick masonry with such manually operable drilling tools without destroying the hollow bricks. For working on hard materials, such as concrete or rock, such drilling tools with a mechanical striking mechanism find less use. Because of the low energy of the individual axial impacts, the user of the drilling tool must press relatively strongly against the material and the achievable drilling progress generally is too little for the professional user.

For working different materials, such as concrete and hollow brick masonry, two or more axial impact-supported manually operable drilling tools are required, the axial impacts of which have the single impact energy and impact frequency, suitable for the respective material, in order to work it with sufficient drilling progress, without at the same time damaging it. In general, buildings are not constructed of a continuously homogenous building material. For example, buildings have concrete load-bearing parts and the sections between these parts frequently consist of brick masonry, especially hollow brick masonry. The tool operator, who is to produce boreholes, openings or the like in these different materials in the past always had to use at least two handheld drilling tools with different stroking mechanisms having different impact energies. Since he cannot be expected to carry along two or more manually operable drilling tools at all times, the procurement of the tool, suitable for the respective material, leads to undesirable delays.

OBJECT OF THE INVENTION

Therefore, it is a primary object of the present invention to provide a remedy for these disadvantages in the state of the art. The tool operator is placed in a position to work the material, without any great delay, using the same drilling tool and working point suitable for such purpose.

SUMMARY OF THE INVENTION

This objective is accomplished in a manually operable drilling tool with a first and a second striking mechanism each arranged to transfer axial impacts to the drilling bit where the axial impacts of each have a different impact energy and impact frequency, with means for operating the striking mechanism, individually, in tandem or for rotating the tool bit without any axial impact. The manually operable drilling tool is equipped with a first striking mechanism, disposed within a housing, for producing axial impacts, which can be transferred to a rotatable drilling or chiseling tool bit, clamped in a tool chuck of the drilling tool. Within the housing, a second striking mechanism is provided for producing axial impacts, which have an impact energy and an impact frequency, different from the impact energy and the impact frequency of the axial impacts produced by the first striking mechanism. The drilling or chiseling tool bit clamped in the chuck can be acted upon by axial impact from either the first or the second striking mechanism or in tandem by using both striking mechanisms together. For special applications, the axial impact mechanisms can be switched off completely.

The manually operable drilling tool of the present invention combines in one tool several drilling tools with striking mechanisms for different single impact energies and impact frequencies. Since such a manually operable drilling tool can be operated with the first striking mechanism providing axial impacts of high energy and low frequency or with the additional striking mechanism offering individual axial impacts of low energy and high frequency, or with both striking mechanisms operating together, the impact output can be adapted very easily to different materials. It is no longer necessary to provide several drilling tools with striking mechanisms for providing axial impacts with different individual impact energies and impact frequencies. The impact parameters of the striking mechanism of the manually operable drilling tool can be adapted at the work site for the materials to be worked. It is self-evident that such a drilling tool can be operated without axial impact support, since both stroking mechanisms can be switched off. This type of operation is desirable, for example, for drilling at a high rpm and without axial impact in wood and metal.

For flexibility in the use of the manually operable drilling tool on a large number of different solid materials, it is advantageous if the individual impact energies of the axial impacts produced by the first and second striking mechanisms have a ratio in the range of about 6: to about 250:1, and preferably in the range of about 10:1 to about 40:1, and if their impact frequencies have a ratio in a range of about 1:1.1 to about 1:15.

It has proven to be advantageous if the first striking mechanism is an electro-pneumatic striking mechanism with an exciter piston disposed within a guiding tube, a free piston and a snap element acting on the drilling or chiseling tool bit disposed forwardly in axial alignment with the guiding tube. Preferably, the second striking mechanism is a mechanical striking mechanism, which interacts with the snap element. The differences in the energies of the individual parts and in the impact frequencies of the striking mechanisms can be achieved, for example, because impacts are produced completely differently by electro-pneumatic and mechanical striking mechanisms.

The mechanical striking mechanism can be constructed as a single ratchet striking mechanism or as a spring U-bolt striking mechanism. From a structural point of view and in order to achieve satisfactory drilling progress in spite of the low impact power, a spring-cam striking mechanism has proven to be advantageous.

In order to cover the largest possible area of use for different, solid materials, it is advantageous if the electro-pneumatic striking mechanism for producing axial impacts is constructed with a large individual impact energy of about 2 J to about 8 J and a low impact frequency of about 45 Hz to about 80 Hz and if the spring-cam striking mechanism for producing axial impacts is constructed with a small individual impact energy of about 0.03 J to about 0.3 J and a high impact frequency of about 50 Hz to about 700 Hz.

For a construction requiring as little space as possible, it is proven advantageous if the spring-cam striking mechanism is disposed coaxially to the guiding tube of the electro-pneumatic striking mechanism and penetrated axially by the snap element. Moreover, the spring-cam striking mechanism has a cam ring, which is disposed non-rotatably in the housing, and has a spring-loaded percussion piston. The percussion piston is disposed so that it can rotate relative to the cam ring and has cams that interact with the cams of the cam ring for producing axial impacts.

Advisably, the percussion piston interacts with a sleeve, which is connected non-rotatably with the machine spindle, and can be driven rotationally. At the same time, the machine spindle forms the guiding tube for the electro-pneumatic striking mechanism. The torque, transmitted to the sleeve by the machine spindle, can be transferred, preferably over a spherical torque transfer element, to the percussion piston. When its cams slide off those of the cam ring, the percussion piston is moved against the restoring force of a cylinder spring, penetrated by the snap element, translatorily from the cams of the cam ring. After passing through the largest stroke, it is disengaged and accelerated back into the starting position by a cylinder spring. At the same time, it strikes against a collar, which is provided at the snap element and mounted ahead of the cam ring. By these means, it is prevented that the axial impact is introduced into the housing over the cam ring.

The striking mechanism of the manually operable drilling tool can be connected or disconnected. For this purpose, for example, in addition to being able to switch the electro-pneumatic striking mechanism, a switching element is provided for the mechanical striking mechanism, by means of which the cams of the percussion piston can be disengaged from the cams of the cam ring. In a particularly advantageous embodiment of the drilling tool, the two striking mechanisms can be actuated automatically, preferably during the operation, as a function of specific criteria, in order to adapt the impact energy and frequency of the axial impacts to the material being worked to set the optimum operating point in this matter.

The novel features which are considered as characteristic for the invention are set forth in particular in the appended claims. The invention itself, however, both as to its construction and its method of operation, together with additional objects and advantages thereof, will be best understood from the following description of specific embodiment when read in connection with the accompanying drawings.

DETAILED DESCRIPTION OF THE INVENTION

Figure 1:
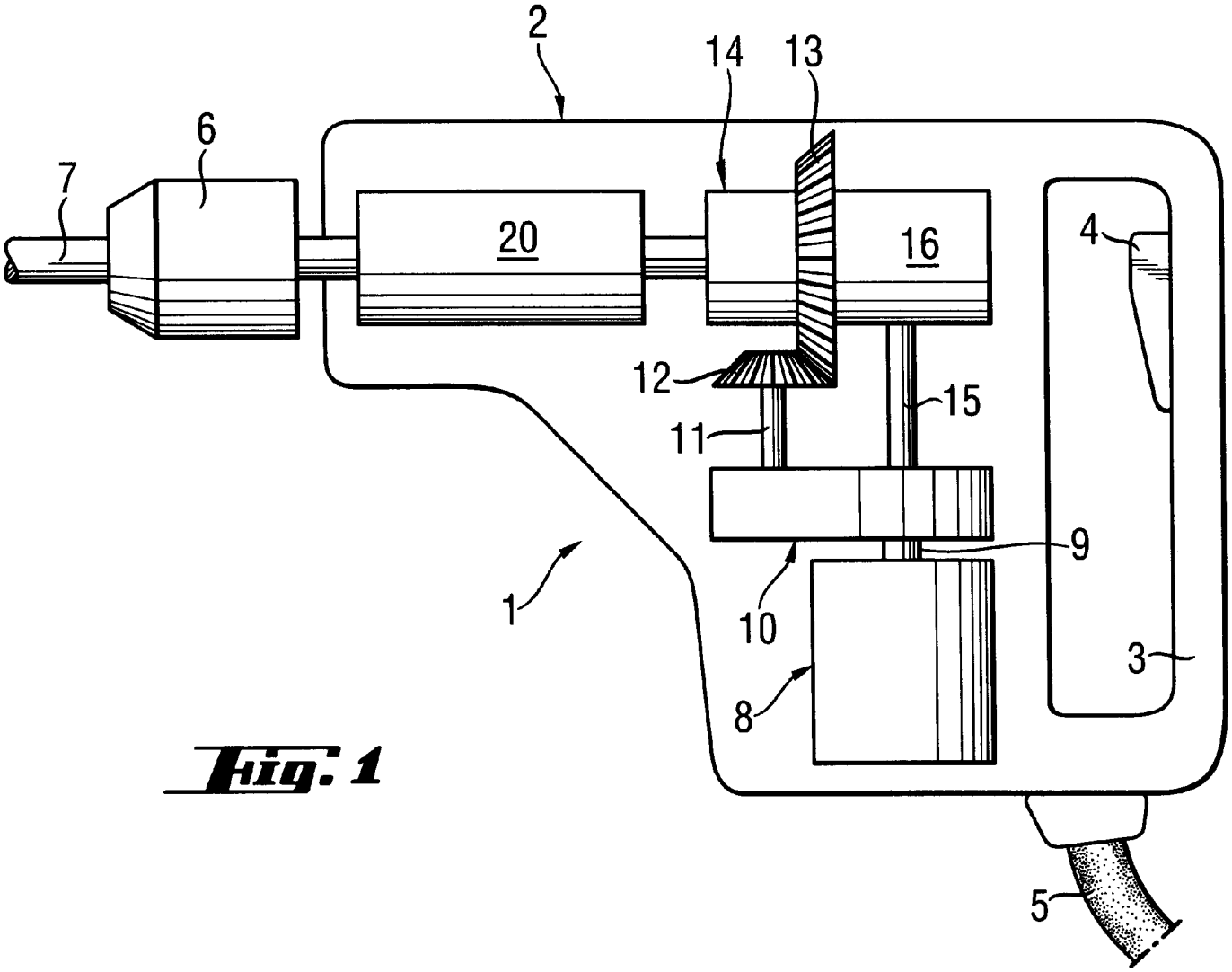
FIG. 1 is a schematic representation of a manually operable drilling tool embodying the present invention.

FIG. 1 is a schematic drawing of a manually operable drilling tool 1 embodying the present invention. The tool has a housing 2 with a handle 3, containing a main switch 4 for activating the drilling tool 1. Electrical components, disposed within the housing 2, are supplied with energy over an electric supply lead 5. At the opposite end of the housing 2 from the handle 3, a chuck 6 is provided, in which a drilling or chiseling tool bit 7 can be clamped, the bit is shown only in part. The drilling tool 1 has an axis of rotation A extending through the chuck **6*b* for the tool bit. An electric driving motor 8 is disposed within the housing 2. A drive shaft 9 of the driving motor 8 is connected with a transmission or drive unit 10 having two outputs. One output of the transmission unit 10 drives or rotates the tool bit 7, clamped in the chuck 6. For this purpose, a drive shaft 11 on the output side of the transmission unit 10 is provided with a tapered spur wheel 12, which engages the peripheral teeth 13 on a machine spindle 14, connected non-rotationally with the chuck 6. A second shaft 15 at the output of the transmission unit 10 drives an electro-pneumatic first striking mechanism 16, disposed within the machine spindle 14. The axial impacts, produced by the electro-pneumatic striking mechanism 16, can be transferred to the tool bit 7, clamped in the 6. To this extent, the construction of the drilling tool 1** corresponds to the known, axial impact-supported hammer drills, as sold, for example, by the assignee.

Contrary to known hammer drills, the hand drilling tool 1 includes a second striking mechanism 20. The axial impacts produced by the second striking mechanism 20 are transferable to the tool bit 7, clamped in the chuck 6, and have an individual impact energy and an impact frequency different from the individual impact energy and impact frequency of the axial impacts produced by the electro-pneumatic first striking mechanism 16. Preferably the second striking mechanism 20 is a mechanical striking mechanism, such as a ratchet striking mechanism, a spring U-bolt striking mechanism or a spring-cam striking mechanism.

Figure 2:
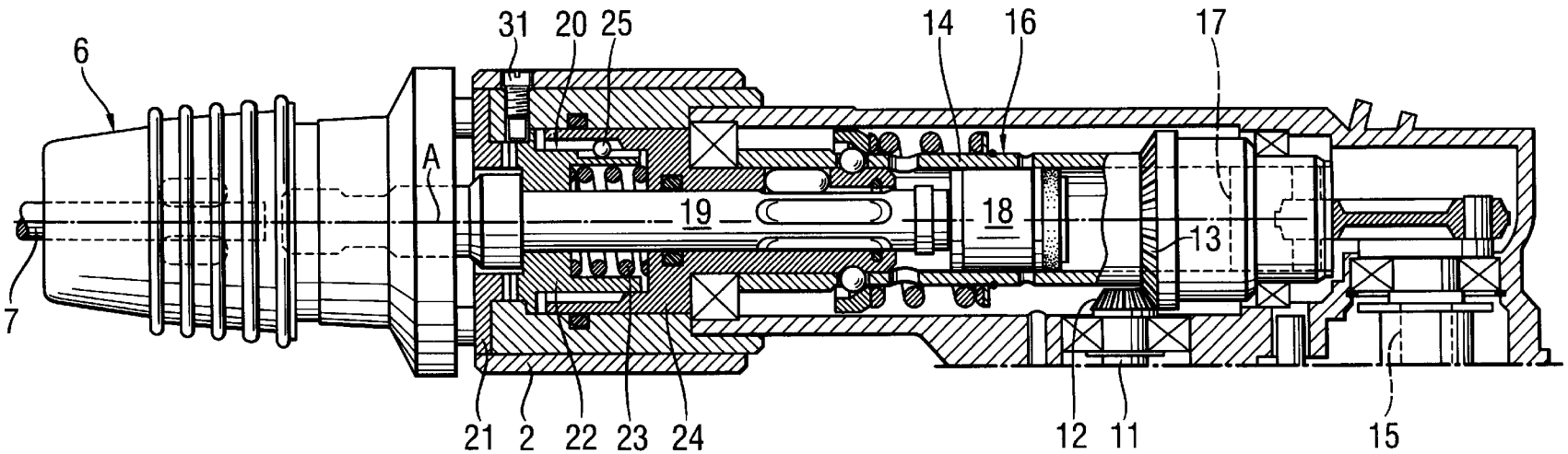
FIG. 2 is an axial section of two striking mechanisms used in the drilling tool in FIG. 1.

FIG. 2 is an axial section of the two striking mechanisms 16 and 20. The description is limited to the details required for an understanding of the invention. The second shaft 15 at the output side of the transmission unit 10 drives an eccentrically mounted exciter piston 17, shown in phantom, of the electro-pneumatic striking mechanism 16. The exciter piston 17 is guided in the interior of the machine spindle 14, which functions as a guiding tube 14 and can be rotated via its outer teeth 13, which interacts rotationally with the tapered spur wheel 12, driven by the drive shaft 11. Due to the eccentric arrangement of the exciter piston 17, the rotational movement of the shaft 15 is converted into a translation of the exciter piston 17 within the guiding tube 14. FIG. 2 shows the exciter piston 17 at its rearward dead center, before it is moved axially in the direction of the chuck 6. An air cushion within the machine spindle or guiding tube 14 transfers the axial motion of the exciter piston 17 to a free piston 18. As a result, the latter carries out a periodic axially reciprocating motion. The forward motion of the free piston 18 in the direction of the tool holding fixture 6 is limited by a snap element 19, which transfers the axial impact from the free piston 18 to the tool bit 7, clamped in the chuck 6. The air cushion between the free piston 18 and the exciter piston 17 prevents the rebounding free piston 18 from striking the exciter piston 17. Electro-pneumatic striking mechanisms are adequately known from the state of the art and are components of the hammerdrills provided by the Assignee. It is self-evident that implement-specific modifications can be provided at the striking mechanism 16, without deviating from the basic principle described. The axial impacts produced by such electro-pneumatic striking mechanisms, have an individual impact energy in the range of about 2 J to about 8 J and are produced with impact frequencies in the range of about 45 Hz to about 80 Hz.

The second striking mechanism 20 is disposed coaxially with the first electro-pneumatic striking mechanism 16. In particular, it is constructed as a spring cam striking mechanism and comprises a cam ring 21, which is held non-rotatably in the interior of the housing 2, and a percussion piston 22, which can be rotated relative to the cam ring 21 and shifted against the restoring force of a spring 23. The cam ring 21 and the percussion piston 22 are penetrated axially by the snap element 19. The spring 23 is supported, on the one hand, at the percussion piston 22 and, on the other, at a sleeve 24, which is rotationally coupled with the machine spindle 14, which forms the guiding tube for the electro-pneumatic striking mechanism 16. The torque of the machine spindle or guiding tube 14, rotated by the driving motor 8, is transferred, on the one hand, over the snap element 19 to the drilling tool 7 clamped in the tool holding fixture 6. On the other hand, the torque is also introduced into the sleeve 24 and transferred over a preferably spherical torque transfer element 25 to the percussion piston 22. A switching clement 31, accessible on the outside of the housing 2, enables the spring-cam striking mechanism to be switched off.

Figure 3:
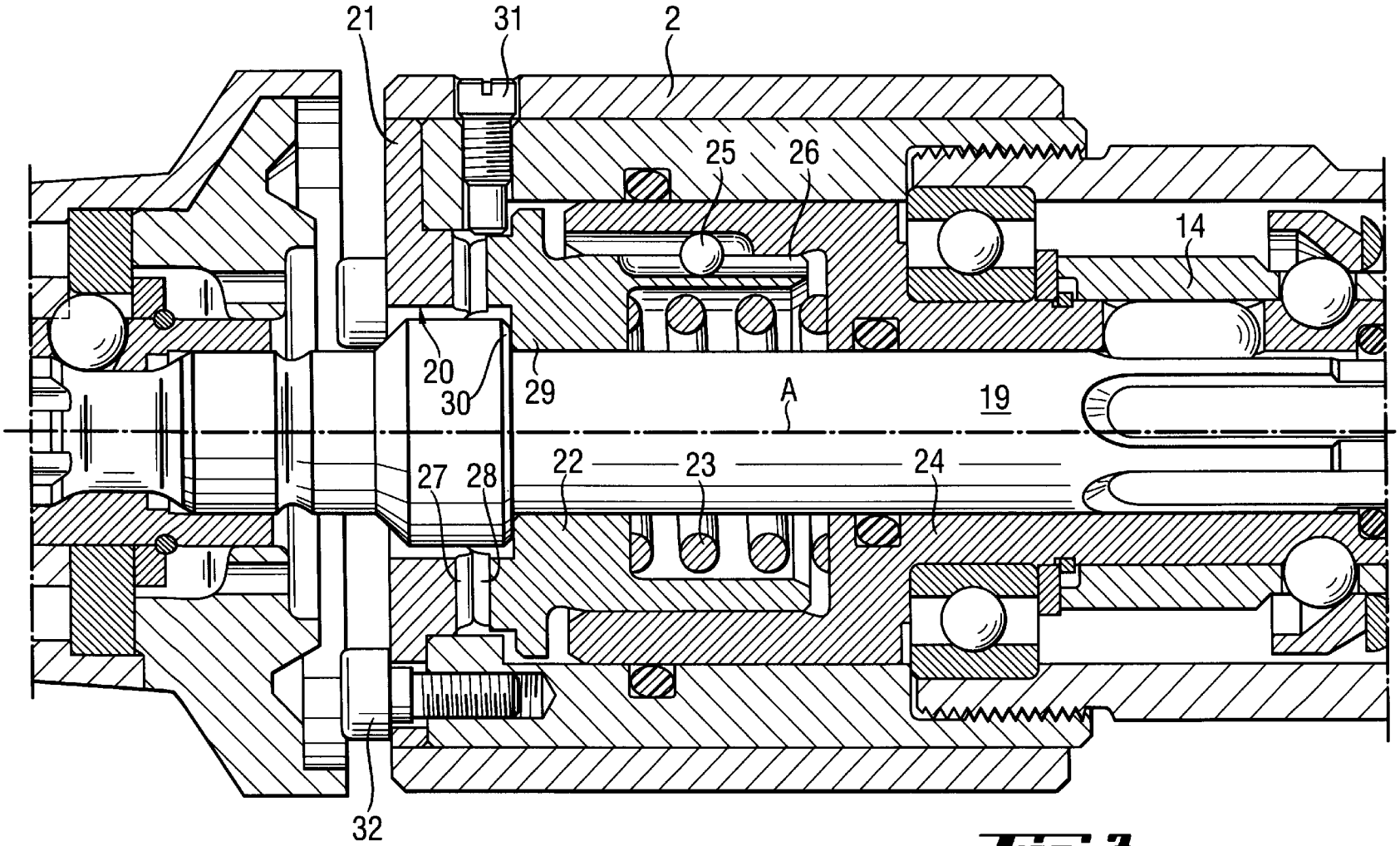
FIG. 3 is an axial section of the mechanical striking mechanism in FIG. 2, shown on an enlarged scale.

FIG. 3 shows the spring-cam second striking mechanism 20 of FIG. 2 on an enlarged scale. The cam ring 21 and the percussion piston 22 are penetrated axially by the snap element 19. The cam ring 21 is connected non-rotationally with the housing 2, for example, by screws 32. The cam ring 21 has cams 27 which, in the switched-on state of the spring-cam second striking mechanism 20, are in engagement with cams 28, which are provided at the side of the percussion piston 22 facing the cam ring 21. The torque of the rotating machine spindle 14 is introduced into the non-rotatably coupled sleeve 24. The spherical torque transfer element 25, disposed between the sleeve 24 and the percussion piston 22 in an axial groove 26, transfers the torque to the percussion piston 22. While the percussion piston 22 is rotating relative to the cam ring 21, the cams 27 and 28 slide over one another and the rotational movement of the percussion piston 22 is converted into a translational movement. At the same time, the percussion piston 22 is moved rearward against the restoring force of the spring 23, which is supported, on the one hand, at the percussion piston 22 and, on the other, at the sleeve 24. Spring 23, which is already pre-tensioned, is tensioned additionally by the stroke, which arises from the height of the cams 27 and 28. As the percussion piston 22 is rotated further relative to the cam ring 21, the largest stroke is exceeded, the edges of the cams 27, 28 slide over one another and the translatory forward motion of the percussion piston is released once again. The tensioned spring 23 accelerates the percussion piston 22 axially in the direction of the cam disk 21, until a collar 29 at the percussion piston 22 strikes against a ring collar 30 on the snap element 19. The ring collar 30 is mounted in front of the cam ring 21 in such a manner, that the axial impact energy of the percussion piston 22 is transferred to the snap element 19 and not introduced into the cam ring 21. The snap element 19 transfers the axial impact, produced by the spring-cam second striking mechanism 20, once again onto the tool bit clamped in the chuck 6.

The individual impact energy of the axial impacts, produced by the second striking mechanism 20, depends on the pretension on the spring 23 and on the height of the cams 27, 28, which is fixed by the stroke. Preferably, the second striking mechanism for producing axial impacts is designed for an individual impact energy of about 0.03 J to about 0.3 J. The impact frequency of the axial impacts depends on the number of cams 27, 28 at the cam disk 21 or at the percussion piston 22, interacting in the peripheral direction. Preferably, the axial impacts can be produced with an impact frequency in the range of about 50 Hz to about 700 Hz.

It can be noted in FIG. 3, that the cams 27, 28 can be disengaged over the switching element 31, in order to switch off the spring-cam second striking mechanism 20. In FIG. 3, the switching element 31 is shown as a twisting and sliding element, which can be actuated manually from outside of the housing 2. It is self-evident that the switching element 31 can also be engaged and disengaged automatically between the cams 27, 28 and activated as a function of specific criteria. For known hammer drills with an electro-pneumatic striking mechanism, this final control element can usually be switched on or off. In conjunction with the spring-cam second striking mechanism 20, which can be switched on or off, there arc many possible variations for operating the inventive manually operable drilling tool. In a first operational variation, the drilling tool 1 can be operated without axial impact support. This may be required, for example, for producing boreholes in steel or wood, which are drilled only at a high rpm without axial impact support. Further operational variations arise out of the alternate activation of the first or the second striking mechanism, as a result of which the axial impact support takes place either with a high individual impact energy and a relatively low frequency, as is required, for example, in concrete, or the axial impacts can be produced with a low individual impact energy and a high impact frequency, for drilling in hollow brick masonry without, at the same time, destroying the bricks. For special applications, the simultaneous activation of both striking mechanisms is also possible.

The invention has been explained using a manually operable drilling tool with an electro-pneumatic first striking mechanism and a spring-cam second striking mechanism as an example. Within the inventive concept, alternative variations of the construction can also provide different combinations of striking mechanisms. For example, an electro-pneumatic striking mechanism can be combined with a ratchet striking mechanism or a spring U-bolt striking mechanism. Manually operable drilling tools, which have two mechanical striking mechanisms with different individual impact energies and impact frequencies, can also be realized. In a further variation, two electro-pneumatic striking mechanisms can also be provided in one manually operable drilling tool, with which axial impacts with individual impact energies of different magnitudes and frequencies can be produced.

While specific embodiments of the invention have been shown and described in detail to illustrate the application of the inventive principles, it will be understood that the invention may be embodied otherwise without departing from such principles.

We claim:

1. A manually operable drilling tool (1) comprising a housing (2), a chuck (6) fitted on said housing and having an axis of rotation (A), a tool bit (7) secured in said chuck for rotation about the axis of rotation, an electro-pneumatic first striking mechanism (16) positioned in said housing (2) and arranged to periodically transfer axially directed impacts to said tool bit (7) via a free piston, a selectively operable spring-biased means, second striking mechanism (20) located within said housing and arranged to transfer axially directed impacts to said tool bit (7), said second striking mechanism spaced axially from said first striking mechanism and formed of a separate arrangement of parts from said first striking mechanism and having an impact energy and an impact frequency different from an impact energy and an impact frequency of said first striking mechanism, and said first and second striking mechanisms being operable together or separately.

2. A manually operable drilling tool, as set forth in claim 1, wherein the impact energy of said axial impact of said first striking mechanism (16) is in a ratio in the range of about 6:1 to 250:1 with said second striking mechanism (20) and the impact frequencies of said axial impacts of said first striking mechanism are in a ratio in the range of about 1:1.1 to 1:15 with said second striking mechanism (20).

3. A manually operable drilling tool, as set forth in claim 2, wherein the impact energy of the axial impact of said first striking mechanism (16) is in a ratio in the range of about 10:1 to about 40:1 with said second striking mechanism (20).

4. A manually operable drilling tool, as set forth in claim 1, wherein said first striking mechanism (16) comprises an exciter piston (17) axially displaceable within a guiding tube (14) extending in the direction of the axis of rotation (A), said free piston (18) in said guiding tube (14) spaced from said exciter piston, and said tool bit located ahead of said free piston and in alignment with said axis of rotation (A), a snap element (19) extending in the axial direction of the axis of rotation between said free piston (18) and said chuck (6), and said second striking mechanism (20) is co-axial with said first striking mechanism and arranged to selectively interact with said snap element (19).

5. A manually operable drilling tool, as set forth in claim 4, wherein said spring-biased means second striking mechanism (20) comprises a spring-cam striking mechanism.

6. A manually operable drilling tool, as set forth in claim 5, wherein said first striking mechanism (16) is arranged to produce axial impacts with a high individual impact energy in the range of about 2 J to about 8 J and a low impact frequency in the range of about 45 Hz to about 80 Hz, and said second striking mechanism is arranged to produce axial impacts with a low individual impact energy in the range of 0.03 J to about 0.3 J and a high impact frequency in the range of about 50 Hz to about 700 Hz.

7. A manually operable drilling tool, as set forth in claim 5, wherein said second striking mechanism (20) is disposed co-axially with said guiding tube (14) of said electro-pneumatic first striking mechanism (16), and with said snap element (19) extending axially through said guiding tube (14).

8. A manually operable drilling tool, as set forth in claim 7, wherein said second striking mechanism (20) comprises a cam ring (21) encircling the axis of rotation in said housing, a spring-loaded percussion piston (22) on an opposite side of said cam ring (21) from said chuck arranged to be rotated relative to said cam ring (21), first cams (27) on said cam ring, second cams (28) on said percussion piston (22) and arranged to interact with said first cams (27) for producing axial impacts of said second striking mechanism (20).

9. A manually operable drilling tool, as set forth in claim 8, wherein said second striking mechanism (20) comprises a sleeve co-axial with the axis of rotation A and with said guiding tube (14) forming a spindle for said first striking mechanism so that the sleeve rotates with said guiding tube, said guiding tube (14) can be driven rotationally about the axis of rotation A, the rotational movement of said sleeve being transferable over a torque transfer element (25) to said percussion piston (22), and said second cams (28) on said percussion piston being rotationally slidable relative to said first cams (27) on said cam ring (21) and being movable against a restoring force of a cylinder spring (23) encircling said snap-element (19) in a translatory manner relative to said first cams (27) of said cam ring (21), and said second cams (28) being disengageable from said first cams (27) and when disengaged strike against a collar (30) on said snap element (19) located forwardly of said cam ring (21) in the axial direction of the axis of rotation.

10. A manually operable drilling tool, as set forth in claim 9, wherein said torque transfer element (25) is a spherical member.

11. A manually operable drilling tool, as set forth in claim 9, wherein a switching element means (31) is provided for switching said second striking mechanism between an on position and an off position and said switching element means (31) is in the off position when said second cams (28) of said percussion piston (22) are disengaged from said first cams (27) of said cam ring (21).

* * * * *